US007448471B2

(12) United States Patent
Nuebling

(10) Patent No.: US 7,448,471 B2
(45) Date of Patent: Nov. 11, 2008

(54) ELEVATOR INSTALLATION

(75) Inventor: Walter Nuebling, Ostfildern (DE)
(73) Assignee: ThyssenKrupp Elevator AG, Duesseldorf (DE)

( * ) Notice: Subject to any disclaimer, the term of this patent is extended or adjusted under 35 U.S.C. 154(b) by 0 days.
(21) Appl. No.: 11/897,923
(22) Filed: Aug. 31, 2007
(65) Prior Publication Data
US 2008/0060882 A1 Mar. 13, 2008
Related U.S. Application Data
(63) Continuation of application No. PCT/EP2005/011540, filed on Oct. 28, 2005.
(30) Foreign Application Priority Data
Mar. 5, 2005 (EP) ..... 05004882
(51) Int. Cl.
*B66B 5/06* (2006.01)
(52) U.S. Cl. ..... 187/286; 187/249; 187/300; 187/305
(58) Field of Classification Search ..... 187/247, 187/248, 249, 277, 279, 282, 286–294, 300, 187/305, 391–394
See application file for complete search history.

(56) References Cited

U.S. PATENT DOCUMENTS
1,896,776 A 2/1933 James
(Continued)
FOREIGN PATENT DOCUMENTS
EP 0 769 469 4/1997
(Continued)
OTHER PUBLICATIONS
*Patent Abstracts of Japan*, vol. 018, No. 138 (M-1573), Mar. 8, 1994, Abstract of Japanese Patent "Speed Controller for Elevator," Publication No. 05319708, Dec. 3, 1993.
(Continued)

*Primary Examiner*—Jonathan Salata
(74) *Attorney, Agent, or Firm*—Lipsitz & McAllister, LLC

(57) ABSTRACT

The invention relates to an elevator installation comprising at least one car, which has a safety gear and with which a control unit, a drive and a brake are associated, and further comprising a safety device for avoiding a collision of the car with an obstacle, another car or an end of the shaft, it being possible by means of the safety device to compare an actual distance of the car from an obstacle, another car or an end of the shaft with a minimum distance and a critical distance. If the actual distance goes below the minimum distance, an emergency stop can be triggered. If the actual distance goes below the critical distance, the safety gear of the car can be triggered. In order to develop the elevator installation in such a way that the distance that is to be maintained at the least by the car from an obstacle, another car or an end of the shaft can be reduced without an emergency stop or a safety gear being triggered, but a car collision can be reliably prevented, it is proposed that it is possible by means of the determining unit of the safety device to determine the critical distance in accordance with a prescribable emergency stop triggering curve and the minimum distance in accordance with a prescribable safety gear triggering curve, the safety gear triggering curve not touching the emergency stop traveling curve, and that it is possible to trigger the safety gear even before the car has reached the location with which the speed of zero is associated according to the emergency stop traveling curve.

16 Claims, 4 Drawing Sheets

U.S. PATENT DOCUMENTS

| | | | | |
|---|---|---|---|---|
| 4,128,141 | A | 12/1978 | Caputo et al. | |
| 4,503,937 | A | 3/1985 | Cervenec et al. | |
| 5,637,841 | A * | 6/1997 | Dugan et al. | 187/294 |
| 5,821,477 | A | 10/1998 | Gerstenkorn | |
| 5,869,794 | A * | 2/1999 | Spiess | 187/287 |
| 5,877,462 | A * | 3/1999 | Chenais | 187/249 |
| 6,032,761 | A * | 3/2000 | Coste et al. | 187/294 |
| 6,082,498 | A * | 7/2000 | Coste et al. | 187/291 |
| 6,435,315 | B1 * | 8/2002 | Zaharia | 187/394 |
| 7,201,256 | B2 * | 4/2007 | Deplazes et al. | 187/300 |
| 2004/0079591 | A1 | 4/2004 | Mueller | |
| 2004/0173413 | A1 | 9/2004 | Angst et al. | |
| 2004/0200671 | A1 | 10/2004 | Kugiya et al. | |

FOREIGN PATENT DOCUMENTS

| | | |
|---|---|---|
| EP | 1 118 573 | 7/2001 |
| WO | 2004/043841 | 5/2004 |
| WO | 2004/043842 | 5/2004 |

OTHER PUBLICATIONS

*Patent Abstracts of Japan*, Abstract of Japanese Patent "Elevator Device," Publication No. 2003327369, published Nov. 19, 2003.

* cited by examiner

ELEVATOR INSTALLATION

This application is a continuation of international application number PCT/EP2005/011540 filed on Oct. 28, 2005.

The present disclosure relates to the subject matter disclosed in international application number PCT/EP2005/011540 of Oct. 28, 2005 and European application number 05 004 882.6 of Mar. 5, 2005, which are incorporated herein by reference in their entirety and for all purposes.

BACKGROUND OF THE INVENTION

The invention relates to an elevator installation comprising at least one car, which can be made to travel in a shaft along a traveling path and has a safety gear, wherein a control unit, a drive and a brake are associated with the car, and further comprising a safety device with a speed determining unit for determining the current speed of the at least one car, a distance determining unit for determining the actual distance of the at least one car from an obstacle, another car or an end of the shaft, and a determining unit for determining a critical distance and a minimum distance, which are dependent on the speed of the at least one car, it being possible by means of the safety device to trigger an emergency stop of the at least one car if the actual distance is less than the critical distance, and it being possible to trigger the safety gear of the at least one car if the actual distance is less than the minimum distance, wherein the movement of the car when an emergency stop is properly performed follows an emergency stop traveling curve, which represents the variation in speed of the car that is to be expected when the emergency stop is triggered, in dependence on the distance covered by the car, and wherein the movement of the car when the safety gear is functioning properly follows a safety gear traveling curve, which represents the variation in speed of the car that is to be expected when the safety gear is triggered, in dependence on the distance covered by the car.

Elevator installations of this type are known from WO 2004/043842 A1. They can be used to transport persons and/or loads in an effective way, in that the at least one car is made to travel up or down within the shaft along the traveling path. To avoid the car colliding with an obstacle, another car or an end of the shaft, the elevator installation has a safety device with a speed determining unit and a distance determining unit, with the aid of which the current speed of the car and the distance of the car from an obstacle, another car or an end of the shaft can be determined. The safety device also has a determining unit by means of which a critical distance, dependent on the speed of the car, can be determined. If the determined distance goes below the critical distance, an emergency stop of the at least one car can be triggered by the safety device. When an emergency stop is performed, the brake associated with the car is activated and, at the same time, its drive motor is deactivated, so that the car can be brought to a standstill with considerable braking acceleration (deceleration) within a short time. In the event of a fault, for example of the brake, to avoid a collision the safety device has a further safety stage, in that the safety gear can be triggered in time before a collision. For this purpose, a minimum distance, dependent on the speed of the at least one car, can be determined by the determining unit. If the actual distance determined by the distance determining unit goes below the minimum distance, the safety gear of the car is activated, so that the latter is brought to a standstill with very high braking acceleration (deceleration) within a very short time. The minimum distance is less than the critical distance, but it is in any event set such that it provides the braking distance that occurs when the safety gear is triggered without a car collision occurring.

When an emergency stop is properly performed, the movement of the car follows an emergency stop traveling curve. This is obtained from the current speed of the car and the braking acceleration (deceleration) occurring when an emergency stop is performed. It represents the variation in speed that is to be expected when the emergency stop is triggered, in dependence on the distance covered by the car.

If the safety gear is triggered, the movement of the car when the safety gear is functioning properly follows a safety gear traveling curve. This is obtained from the current speed of the car and the braking acceleration (deceleration) occurring when the safety gear is active. It represents the variation in speed that is to be expected when the safety gear is triggered, in dependence on the distance covered by the car.

In WO 2004/043842 A1, it is proposed to determine both the critical distance and the minimum distance in dependence on the speed of the car. This provides the possibility of shortening the critical distance and also the minimum distance when the car has a low speed, since in this case only a relatively short braking distance is required for braking the car. If, on the other hand, the car has a relatively high speed, allowance must be made for long braking distances and, accordingly, both the critical distance and the minimum distance must be chosen to be greater.

The fact that first an emergency stop and, if it malfunctions, the safety gear can be triggered one after the other to avoid a car collision means that the collision of a car can be reliably prevented. To make sure that the car can be brought to a standstill by means of the safety gear in the event of a malfunction of the emergency stop, usually a large value is used for the critical distance, even at low car speeds. This has the advantage that, after triggering an emergency stop, it can first be checked whether the movement of the car follows the emergency stop traveling curve to the speed of zero. If this is not the case, the safety gear can still be triggered to bring the car to a standstill after running through the safety gear traveling curve. However, this entails the disadvantage that, in normal operation, the at least one car must be at a considerable distance from an obstacle, another car or an end of the shaft even at low speeds. In particular when using a number of cars which can be made to travel independently of one another along a common traveling path, it may have the consequence that two cars cannot simultaneously travel to two floors that are directly one above the other, since the distance between the floors is in many cases smaller than the distance between the cars that is to be maintained to avoid the triggering of an emergency stop or the safety gears.

It is an object of the invention to develop an elevator installation of the type mentioned at the beginning in such a way that the distance that is to be maintained by the at least one car from an obstacle, another car or an end of the shaft can be reduced without an emergency stop or a safety gear being triggered, but a car collision can be reliably prevented.

SUMMARY OF THE INVENTION

This object is achieved according to the invention in the case of an elevator installation of the generic type by it being possible by means of the determining unit to determine the critical distance in accordance with a prescribable emergency stop triggering curve and the minimum distance in accordance with a prescribable safety gear triggering curve, the safety gear triggering curve not touching the emergency stop traveling curve, and by it being possible to trigger the safety gear even before the car has reached the location with which the speed of zero is associated according to the emergency stop traveling curve.

While the critical distance is usually set such that it corresponds in any event to at least the sum of the braking distances which are covered when braking the car from its current speed to the speed of zero during an emergency stop and in addition also with the safety gear acting, it is provided according to the invention that the critical distance can be determined in accordance with a prescribable emergency stop triggering curve and the minimum distance can be determined in accordance with a prescribable safety gear triggering curve, the safety gear triggering curve not touching the emergency stop traveling curve and it being possible to trigger the safety gear already even before the at least one car has reached the location with which the speed of zero is associated according to the emergency stop traveling curve, that is when an emergency stop is properly performed. This makes it possible in particular that the safety gear can already be triggered while the car is still covering the distance during which it is braked when an emergency stop is properly performed. It is therefore no longer necessary to wait to see whether, after triggering the emergency stop, the car is properly braked by means of the brake associated with it before triggering the safety gear, if necessary, but instead the safety gear can be triggered irrespective of whether or not braking is properly performed during an emergency stop.

An emergency stop triggering curve can be prescribed to the determining unit, for example by corresponding curve parameters and a computing algorithm or else by stored pairs of values. This curve represents the stopping distance of the car that is to be expected when the emergency stopping device is triggered, in dependence on the speed of the car previously prevailing when the emergency stop is triggered. The emergency stop triggering curve incorporates not only the actual braking behavior of the at least one car when an emergency stop is performed, but also possible delay times between the triggering of the emergency stop and the coming into effect of the brake.

A safety gear triggering curve may also be prescribed to the determining unit, for example by corresponding curve parameters and a computing algorithm or else by stored pairs of values, which curve describes the stopping distance of the car that is to be expected when the safety gear is triggered, in dependence on the speed of the car prevailing when the safety gear is triggered. The determination of the safety gear triggering curve not only includes the actual braking behavior of the at least one car when the safety gear is active, but may also take into account reaction times between the triggering of the safety gear and it actually coming into effect.

The emergency stop triggering curve and the emergency stop traveling curve are coupled to each other. While the emergency stop traveling curve merely describes the actual braking behavior of the car, the emergency stop triggering curve also makes allowance additionally for system reaction times. The same applies correspondingly to the safety gear triggering curve and the safety gear traveling curve, which are likewise coupled to each other. The emergency stop triggering curve is prescribed in such a way that the emergency stop traveling curve does not touch the safety gear triggering curve. This ensures that, when an emergency stop is triggered and braking of the at least one car is subsequently properly performed, the safety gear is not triggered. However, if emergency stopping does not occur properly, the safety gear can be triggered at any time even before the car has reached the location with which the speed of zero is associated according to the emergency stop traveling curve. It is therefore no longer necessary to wait first until the car has covered the emergency stop braking distance that is to be expected in accordance with the emergency stop traveling curve after triggering an emergency stop, but instead the safety gear can be triggered at any time if it is established by means of the speed and distance determining unit that the movement of the car is not following the emergency stop traveling curve after triggering of the emergency stop.

In order to ensure that the safety gear is not triggered when an emergency stop is properly performed, in which the movement of the car follows the emergency stop traveling curve, in a preferred embodiment the emergency stop traveling curve is offset at the speed of zero by a prescribable distance value in relation to the safety gear traveling curve. By offsetting the emergency stop traveling curve, the stopping point of the car after carrying out an emergency stop is spaced apart from the stopping point of the car after braking by means of the safety gear. The distance between the two stopping points corresponds to the prescribed distance value. These different stopping points make it possible to ensure in a structurally simple way that the safety gear is not mistakenly triggered when the emergency stop is properly performed.

It is of advantage if the car can be braked in normal operation by means of the control unit in accordance with a prescribable operational deceleration curve, the operational deceleration curve not touching the emergency stop triggering curve and it being possible for an emergency stop to be triggered even before the car to be braked has reached the location with which the speed of zero is associated according to the operational deceleration curve. In normal operation, the at least one car is controlled by the control unit. If the car is to be brought to a standstill in normal operation, it is possible for this purpose to prescribe to the control unit an operational deceleration curve which represents the stopping distance of the car that is operationally to be expected, in dependence on the speed of the car prevailing at the beginning of the braking. The operational deceleration curve is offset in relation to the emergency stop triggering curve, so that the two curves do not touch and it is thereby ensured that an emergency stop is not mistakenly triggered in normal operation when the car is braked in the operationally proper manner. However, in the event of a fault, an emergency stop can already be triggered even before the car to be braked has reached the location with which the speed of zero is associated according to the operational deceleration curve. In particular, an emergency stop can be triggered if it is established by means of the speed and distance determining unit that there is a deviation of the car movement from the operational deceleration curve. For this purpose, the actual movement of the car can be compared with the movement that is to be expected according to the operational deceleration curve and an emergency stop can be triggered if there is a deviation.

The operational deceleration curve is preferably offset at the speed of zero by a distance value in relation to the emergency stop traveling curve.

It is of advantage if the critical distance and the minimum distance can be determined independently of each other. In an embodiment of this type, it is in particular not required for the minimum distance first to be determined for the determination of the critical distance.

It is advantageous if the car can be braked in normal operation by means of the control unit in accordance with a prescribable operational deceleration curve, the operational deceleration curve, the emergency stop traveling curve and the safety gear traveling curve being offset at the speed of zero both in relation to one another and in relation to the position of an obstacle, another car or an end of the shaft. The offset disposition of the curves in relation to one another ensures that an emergency stop is not triggered and the safety gear is not activated when the car is braked in the operationally proper manner by means of the control unit. If an emergency stop is triggered and emergency stop braking of the car takes place in the proper manner, the safety gear is not triggered on account of the offset disposition of the curves. The offset disposition of all the curves in relation to the position of an obstacle, another car or an end of the shaft ensures that the car is in any event brought to a standstill at a stopping point which is disposed at the safety distance from the obstacle, from another car or from an end of the shaft.

In a preferred embodiment, the minimum distance can be determined taking into account the current speed of the car as well as the system reaction time, the drawing-in distance and the braking acceleration of the safety gear of the at least one car. The current speed can be determined by means of the speed determining unit or else by means of a sensor, and the system reaction time, the drawing-in distance and the braking acceleration of the safety gear can be prescribed to the determining unit as parameters which are dependent on the structural configuration of the safety gear. Referred to as the system reaction time is the time which is required for triggering the safety gear, that is its preferably electronic activation, and for the mechanical response of the safety gear. The drawing-in distance is the distance which the car covers while the safety gear is transferred from its rest position into its braking position, delivering the full braking effect. The braking acceleration (deceleration) is the change in speed achievable per unit of time which can be achieved by means of the fully active safety gear. The system reaction time, drawing-in distance and braking acceleration represent installation-specific parameters of the safety gear of the respective car.

In order to ensure that, when it is at a standstill, the braked car in any event assumes a distance from an obstacle, an end of the shaft or another car, it is provided in a preferred embodiment that the minimum distance can be determined taking into account a prescribable safety distance which the car brought to a standstill is to assume at the least from an obstacle, another car or an end of the shaft.

The determination of the minimum distance may take place by speed-dependent minimum distance values being stored in a table of the determining unit. It is of particular advantage if the minimum distance can be calculated by means of the determining unit, it being possible to input the system reaction time, the drawing-in distance and the braking acceleration of the safety gear into the determining unit. It is of advantage if the determining unit is programmable. For the calculation of the speed-dependent minimum distance, an algorithm may be prescribed to the determining unit. It can therefore be provided that the minimum distance can be calculated from the stopping distance $s_{FA}$ of the at least one car that is to be expected when the safety gear is triggered. The stopping distance $s_{FA}$ is obtained according to the following formula:

$$s_{FA}=v\cdot t_{reak}+s_{Ein}+v^2/2a_{FA} \quad (1)$$

where:

$s_{FA}$ is the stopping distance of the car when the safety gear is triggered v is the actual speed of the car $t_{reak}$ is the system reaction time of the safety gear of the car $s_{Ein}$ is the drawing-in distance of the safety gear of the car $a_{FA}$ is the braking acceleration (deceleration) of the safety gear The term $v\cdot t_{reak}$ describes the distance covered by the car during the system reaction time of the safety gear, and the term $v^2/2a_{FA}$ describes the braking distance of the car when the safety gear is active. The reaction distance and the braking distance are dependent on the speed of the car. The drawing-in distance $s_{Ein}$ of the safety gear is speed-independent, since the transfer of the safety gear from its rest position into its braking position is directly dependent on the relative movement of the car with respect to a speed limiting rope which can be blocked to trigger the safety gear.

The formula (1) given above takes the form of the safety gear triggering curve when it is represented in a system of coordinates as a diagram.

In a further step, the minimum distance can be calculated from the stopping distance $s_{FA}$ of the car. If the car approaches a stationary obstacle or an end of the shaft, the minimum distance can be equated with the stopping distance $s_{FA}$. If the car approaches another car, coming toward it, the minimum distance corresponds to the sum of the stopping distances $s_{FA}$ of the two cars. For this purpose, the speed-dependent stopping distances $s_{FA}$ of the two cars and the resultant minimum distance between the two cars are continuously calculated by the determining unit.

The minimum distance may be regarded as a distance ahead of at least one car for the triggering of the safety gear. If the extreme end of this distance meets an obstacle, an end of the shaft or another car, the safety gear is triggered. If the already explained safety distance is additionally added to the aforementioned stopping distance $s_{FA}$, it is ensured that the car comes to a standstill away from the obstacle, an end of the shaft or another car by the safety distance.

In an advantageous embodiment, the critical distance that is decisive for the triggering of an emergency stop can be determined taking into account the current speed of the car and also the system reaction time and the braking acceleration of the brake associated with the at least one car and also a prescribable traveling curve distance value, the prescribable traveling curve distance value corresponding to the distance of the emergency stop traveling curve from the safety gear traveling curve at the speed of zero. The time between the triggering of the emergency stop and the response of the mechanical brake is understood as the system reaction time, and the braking acceleration (deceleration) of the brake corresponds to the change in speed per unit of time that can be achieved by means of the brake. As already explained, it is ensured by the traveling curve distance value in a structurally simple way that the safety gear is not mistakenly triggered when an emergency stop is properly performed.

The critical distance can be determined taking into account a prescribable safety distance which the car brought to a standstill by means of the emergency stopping device is to assume at the least from an obstacle, another car or an end of the shaft.

For the determination of the critical distance, the determining unit may have a table which, in dependence on the speed of the car, represents in each case the associated critical distance. In a particularly preferred embodiment, it is provided that the critical distance can be calculated by means of the determining unit, it being possible to input the system reaction time and the braking acceleration of the brake associated with the at least one car into the determining unit as installation-specific parameters. The determining unit is preferably programmable. An algorithm may be prescribed to the determining unit in order to calculate the decisive critical distance on the basis of the input parameters. It can therefore be provided that the critical distance can be calculated from the stopping distance $s_{NH}$ of the at least one car that is to be expected when an emergency stop is triggered. The stopping distance $s_{NH}$ is obtained according to the following formula:

$$s_{NH}=v\cdot t_{reak}+v^2/2a_{NH} \quad (2)$$

where:

$s_{NH}$ is the stopping distance of the car when an emergency stop is triggered v is the actual speed of the car $t_{reak}$ is the system reaction time of the brake associated with the car $a_{NH}$ is the braking acceleration (deceleration) of the brake The term $v\cdot t_{reak}$ describes the reaction distance covered during the system reaction time from the triggering point of the emergency stop to the response of the electromechanical brake, and the term $v^2/2a_{NH}$ describes the actual braking distance of the car when the brake is active.

The formula (2) given above takes the form of the emergency stop triggering curve when it is represented in a system of coordinates as a diagram.

In a further step, the critical distance can be calculated from the stopping distance $s_{NH}$ of the car. If the car approaches a stationary obstacle or an end of the shaft, the critical distance can be equated with the stopping distance $s_{NH}$. If the car approaches another car, coming toward it, the critical distance corresponds to the sum of the stopping distances $s_{NH}$ of the two cars. For this purpose, the speed-dependent stopping distances $s_{NH}$ of the two cars and the resultant critical distance are continuously calculated by the determining unit.

The critical distance may likewise be regarded as a distance ahead of at least one car for the triggering of an emergency stop. If the extreme end of this distance meets an obstacle, an end of the shaft or another car, the emergency stop is triggered. If a safety distance is also added to the stopping distance $s_{NH}$, it is ensured that the car comes to a standstill away from the obstacle, an end of the shaft or another car by the safety distance. If the traveling curve distance value is also additionally added to the stopping distance $s_{NH}$, it is ensured that the emergency stop traveling curve does not touch the safety gear triggering curve and consequently the safety gear is not triggered when an emergency stop is properly performed.

For determining the distance of the car from another car or from an end of the shaft and for determining its speed, a shaft information system which is coupled to the safety device may be used.

The shaft information system preferably comprises a position sensor, which transmits the position of an associated car to the safety device.

It is of particular advantage if, in addition to the position of the associated car, the position sensor also transmits to the safety device its speed and/or its direction of movement.

The elevator installation preferably has an optical shaft information system, for example a barcode information system, which is coupled to the safety device. The barcode information system may comprise a carrier which extends along the shaft and on which barcode symbols are disposed, and on each car a barcode reader may be additionally used, with the aid of which the barcode symbols can be registered. The barcode readers may, for example, take the form of laser scanners. By means of the barcode readers, the barcode disposed on the carrier can be optically read. This barcode may represent the current position of the car, and the change in the position per unit of time represents a measure of the speed of the car on which the barcode reader is mounted. Also the direction of movement of the car can be registered by means of the barcode information, system, in that successive positional data are evaluated. The barcode information system can supply the speed determining unit and the distance determining unit with electrical signals which contain all the information for determining the position, the traveling direction and the speed of the respectively associated car.

Alternatively or additionally, the elevator installation may comprise a magnetic system for determining the car position, the car speed and/or the direction of movement of the car. It may also be provided that this information can be determined by means of a laser beam. Furthermore, the elevator installation may be configured in such a way that the position of the car can be provided by absolute value rotary encoders. Inductively operating sensors can also determine the position, or the distance determination may be carried out with ultrasonic sensors.

It is of particular advantage if the elevator installation comprises at least two cars which can be made to travel up and down independently of each other, are coupled to the safety device for triggering an emergency stop and for triggering the safety gear of the respective car, the determining unit of the safety device continuously calculating on the basis of the speeds and the traveling directions of the cars the stopping distances of the cars when an emergency stop is performed and when their safety gears are triggered and determining on the basis of the stopping distances the critical distance and the minimum distance of the cars in relation to one another, and it being possible by means of a comparing unit of the safety device for the actual distance between the cars to be compared with the critical distance and the minimum distance.

The following description of a preferred embodiment of the invention serves for further explanation in conjunction with the drawings.

DETAILED DESCRIPTION OF THE INVENTION

Figure 1:
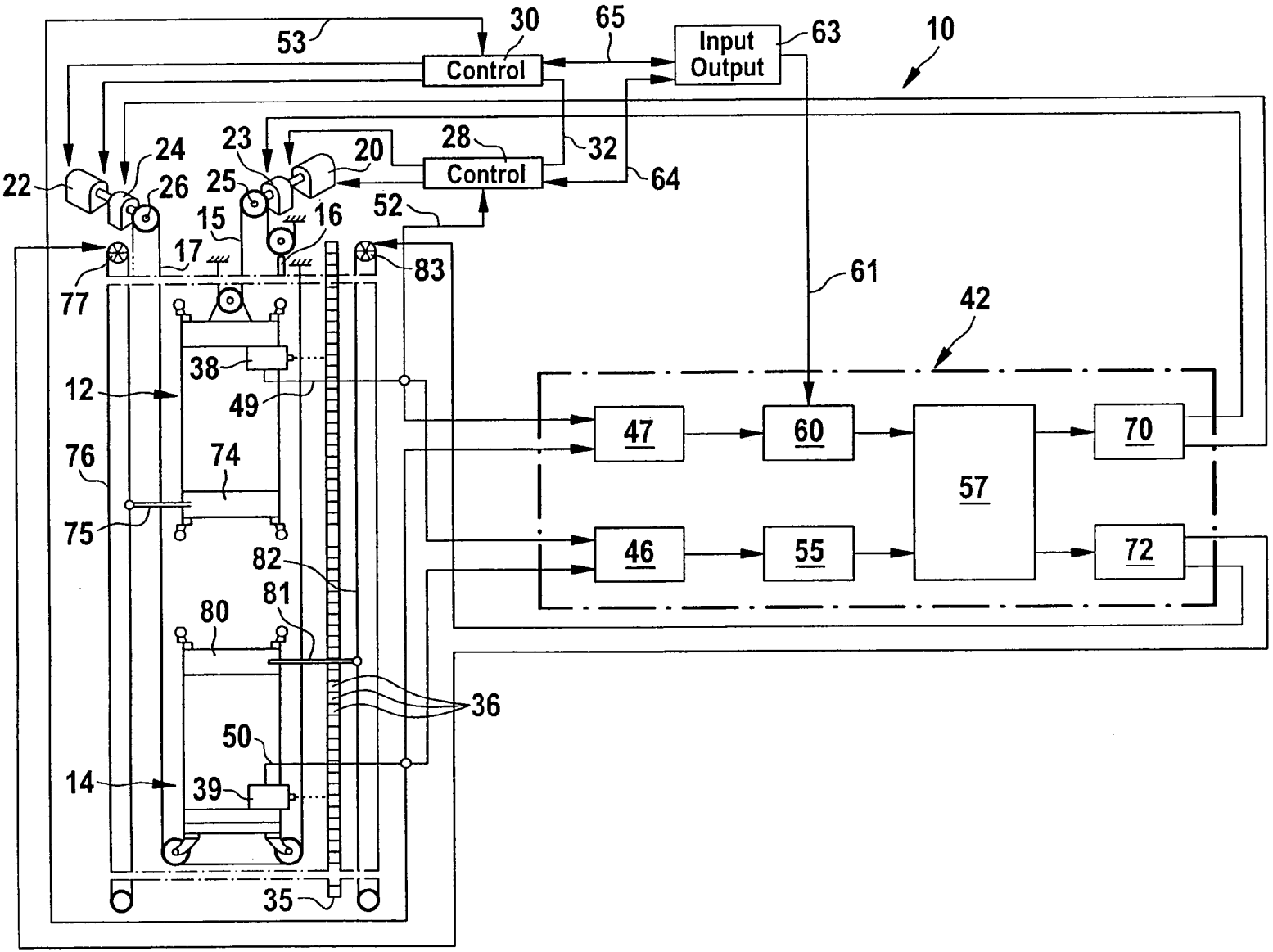
FIG. 1 shows a schematic representation of an elevator installation according to the invention.

In FIG. 1, a preferred embodiment of an elevator installation according to the invention is represented in a greatly schematized form and provided overall with the reference numeral 10. It comprises two cars 12, 14, which are disposed one above the other in a shaft (not represented in the drawing) and can be made to travel up and down independently of each other along a common traveling path, which is known per se and therefore not represented in the drawing. The upper car 12 is coupled to a counterweight 16 via a suspension rope 15. The lower car 14 is held on a suspension rope 17, which interacts in a way corresponding to the suspension rope 15 with a counterweight, which however is not represented in the drawing in order to achieve a better overview.

A separate drive in the form of an electric drive motor 20 and 22 respectively is associated with each car 12, 14, and in each case also a separate electromechanical brake 23 and 24, respectively. A traction sheave 25 and 26, respectively, is associated with the drive motors 20, 22 in each case, over which the suspension ropes 15 and 17 are led.

The guidance of the cars 12, 14 in the vertical direction along the common traveling path is performed by means of guide rails that are known to the person skilled in the art and therefore not represented in the drawing.

A separate control unit 28 and 30, respectively, is associated with each car 12, 14, for controlling the cars 12, 14 in normal operation. The control units 28, are in electrical connection via control lines with the respectively associated drive motor 20 and 22 and also with the associated brake 23 and 24, respectively. In addition, the control units 28, 30 are directly connected to one another via a connecting line 32. By means of the drive motors 20, 22 and the control units 28, 30, the cars 12, 14 can be made to travel up and down in a customary way within the elevator shaft for the transportation of persons and/or loads.

Disposed outside the cars 12, 14 on each floor to be served are destination input units, which are known to the person skilled in the art and therefore not represented in the drawing in order to achieve a better overview. By means of the destination input units, the desired destination can be input by the user, and on an indicating unit disposed alongside the respective destination input unit, for example a screen, the car selected by the control units 28, 30 to go to the destination can be indicated to the user. All the destination input units are in electrical connection with the control units 28 and 30 via bidirectional transmission lines. They may be configured for example as touch-sensitive screens in the form of so-called touch screens, which make possible simple input of the destination and simple indication of the car to be used.

The control units 28, 30 respectively associated with a car 12, 14 are connected to one another via data lines 32 and, together with further control units of elevators not represented, they form an elevator group, each control unit 28, 30 within the group being able to control the associated car 12 and 14, respectively. In connection with a destination input provided by the user via the destination input units disposed outside the cars, the control units can perform a very rapid car assignment and carry out optimized travel control, and in this way achieve a high handling capacity extremely safely.

The elevator installation 10 has a shaft information system in the form of a barcode carrier 35, which extends along the entire traveling path and carries barcode symbols 36, which can be optically read by barcode readers 38 and 39 respectively disposed on a car 12, 14. The barcode symbols 36 represent a position indication in coded form and are read by the barcode readers 38, 39. The position indications that are consequently registered contactlessly are output as electrical signals by the barcode readers 38, 39.

If the cars 12, 14 move within the shaft, the respective position of the cars 12, 14 is registered by means of the associated barcode readers 38, 39. The speeds of the cars 12 and 14 can be determined from the change in the positional data per unit of time. In addition, the scanning of the barcode symbols 36 makes it possible to determine the traveling direction of the cars 12, 14 from the successive position indications.

The cars 12, 14 are in connection with an electrical safety device 42 of the elevator installation 10. This comprises a position evaluating unit 46 and a speed determining unit 47 with integrated traveling direction evaluation.

The position evaluating unit 46 and the speed determining unit 47 are in electrical connection via data lines 49 and 50 with the barcode readers 38 and 39, respectively, of the upper car 12 and of the lower car 14. This connection may also take place by means of optical fibers or be wirelessly configured. The position evaluating unit 46 and the speed determining unit 47 process the signals provided by the barcode readers 38 and 39 into car-dependent position and speed signals. The control units 28 and 30 also have corresponding position evaluating units and speed determining units, which are electrically connected via input lines 52, 53 to the data lines 49 and 50, respectively. Consequently, the information provided by the barcode readers 38 and 39 concerning the position, the traveling direction and the speed of the cars 12 and 14 is available not only to the safety device 42, but also to the control units 28 and 30 associated with the respective cars. The speed determination, the traveling direction evaluation and/or the position determination may also be integrated directly in the barcode readers 38, 39, so that these readers 38, 39 can directly output the speed and the traveling direction as intelligent sensors.

The safety device 42 has a distance determining unit 55, which is in electrical connection with the position evaluating unit 46 and continuously calculates from the positional data provided the actual distance of the two cars 12 and 14 from each other. An electrical signal corresponding to the actual distance is passed on from the distance determining unit 55 to a comparing unit 57 of the safety device 42. The comparing unit 57 has two inputs. Provided at a first input is the signal of the distance determining unit 55, representing the actual distance between the two cars 12, 14. The second input is connected to a determining unit 60, which is in electrical connection with the speed determining unit 47 and is additionally connected via input lines 61 to a central input and output unit 63 of the elevator installation 10. The latter may be in electrical connection with the control units 28 and 30, respectively, via bidirectional lines 64 and 65—as in the exemplary embodiment represented. By means of the input and output unit 63, the control units 28, 30 can be programmed and installation-specific parameters can be input both into the control units 28, 30 and into the determining unit 60.

By means of the determining unit 60, during the operation of the elevator installation 10 a critical distance and a minimum distance are continuously calculated for the cars 12 and 14 in a way explained in more detail below. The critical distance and similarly the minimum distance are compared with the actually existing distance between the two cars 12 and 14 with the aid of the comparing unit 57. If the actual distance between the cars 12 and 14 goes below the critical distance, the comparing unit 57 outputs to a downstream emergency stop triggering device 70 a control signal which causes the emergency stop triggering device 70 to activate the brake 23 or 24 respectively associated with the cars 12 and 14, so that both cars 12, 14 are braked within a short time. If the actual distance goes below the minimum distance, the comparing unit 57 outputs a control signal which causes a safety gear triggering device 72 downstream of the comparing unit 57 to trigger both a safety gear 74 of the upper car 12 and a safety gear 80 of the lower car 14. By means of the safety gears 74 and 80, the cars 12, 14 can be braked in a mechanical way in a very short time, in order to avoid a car collision.

The safety gear 74 is coupled via a safety gear linkage 75 to a speed limiter rope 76 in a way which is known per se and therefore only schematically represented in the drawing. The speed limiter rope 76 is led in a customary way over a deflecting roller, disposed at the lower end of the elevator shaft, and a speed limiter 77, disposed at the upper end of the elevator shaft. If a maximum speed of the car 12 is exceeded, the speed limiter 77 can trigger the safety gear 74 via the speed limiter rope 76 and the safety gear linkage 75 fixed to the latter, so that the upper car is brought to a standstill within a short time. In addition, the speed limiter 77 or another device in operative connection with the speed limiter rope 76, for example a rope brake, may be electrically activated by the safety gear triggering device 72, in order to block the speed limiter rope 76 and thereby trigger the safety gear 74 if the distance goes below the minimum distance.

The safety gear of the lower car 14 is coupled via a safety gear linkage 81 to a speed limiter rope 82, which is led over a deflecting roller, disposed at the lower end of the elevator shaft, and a speed limiter 83, disposed at the upper end of the elevator shaft. If a maximum speed is exceeded, the lower car can be braked within a short time, in that the safety gear 80 is triggered by the speed limiter 83 via the speed limiter rope 82 and the safety gear linkage 81. In a way corresponding to the car 12, it is also the case for the car 14 that the speed limiter 83 or another device in operative connection with the speed limiter rope 82, for example a rope brake, may additionally be electronically activated by the safety gear triggering device 72, if the actual distance between the lower car 14 and the upper car 12 goes below the minimum distance calculated by the determining unit 60.

Figure 2:
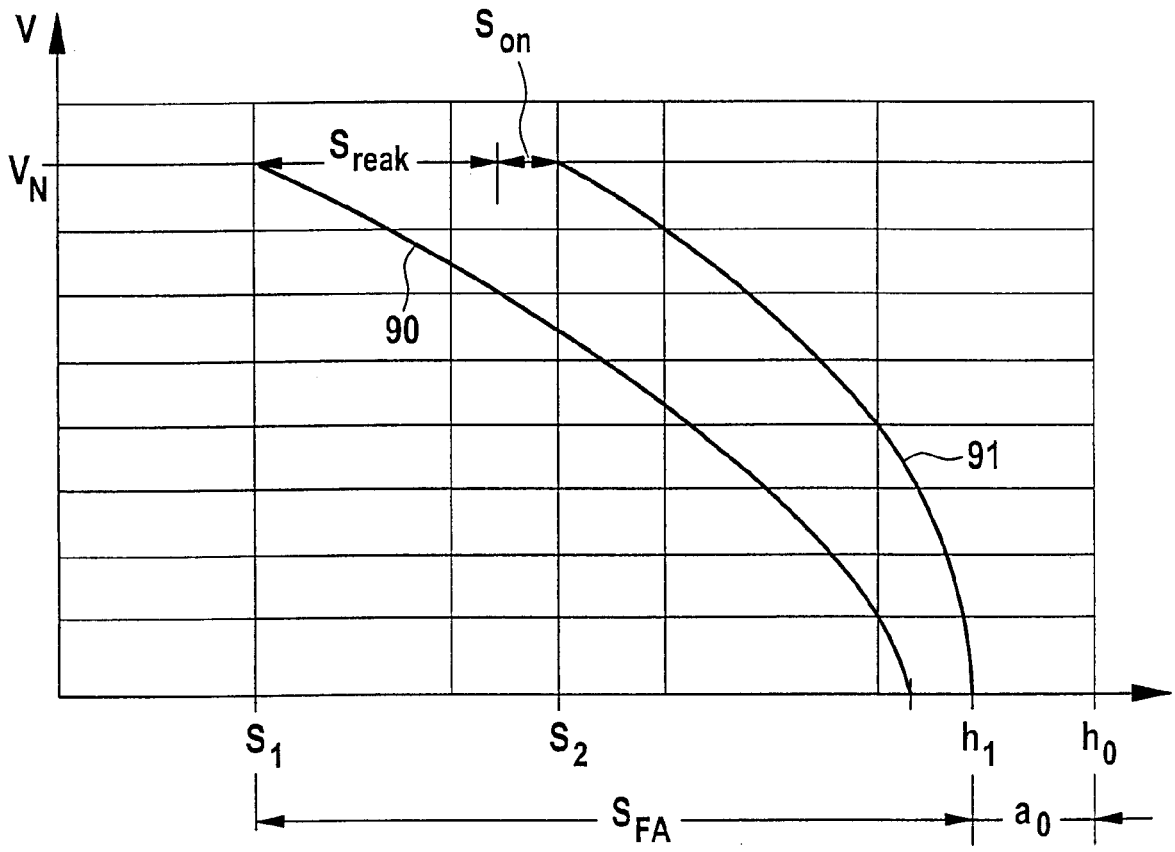
FIG. 2 shows a safety gear triggering curve and a safety gear traveling curve of a car of the elevator installation.

The calculation of the minimum distance and similarly the calculation of the critical distance take place on the basis of installation-specific parameters, which can be input into the determining unit 60 via the input line 61, via which the determining unit 60 is in electrical connection with the central input and output unit 63. The calculation of the minimum distance takes place in accordance with a prescribable safety gear triggering curve 90, as schematically represented in FIG. 2. The safety gear triggering curve 90 represents the relationship between the stopping distance $s_{FA}$ of the cars 12 and 14, respectively, that is to be expected when the safety gears 74, 80 are triggered and the actual speeds of the cars 12, 14 when the safety gears 74, 80 are triggered. If, for example, the car 12 moving at a nominal speed $v_N$ is brought to a standstill at the safety distance $a_0$ before an absolute stopping point $h_0$, so that its speed at the stopping point $h_1$ disposed at the distance $a_0$ from the absolute stopping point $h_0$ is zero, for this purpose the safety gear 74 must be triggered at the location $s_1$, which is away from the stopping point $h_1$ by the stopping distance $s_{FA}$.

Consequently, with respect to the absolute stopping point $h_0$, for example an end of the shaft, the minimum distance is obtained from the sum of the stopping distance $s_{FA}$ and the safety distance $a_0$.

The triggering of the safety gear 74 takes place by the speed limiter 77 and the speed limiter rope 76, being blocked. This has the consequence that the car 12 is initially still moved at the same nominal speed $v_N$, until it reaches the location $s_2$, since the system reaction time of the safety gear 74 must be taken account of when triggering it, this reaction time corresponding to the time interval from the output of a signal by the safety gear triggering device 72 to the initial response of the safety gear 74. After the system reaction time has elapsed, and after the reaction distance $S_{reak}$ covered during this time, it must additionally be taken into consideration the drawing-in distance $S_{Ein}$, which corresponds to the distance covered by the car 12 from the initial response of the safety gear 74 until its full braking effect. Only once the full braking effect is delivered is the car 12 effectively braked to the speed of zero in the region between the location 52 and the stopping point $h_1$ in accordance with the safety gear traveling curve 91. It is clear that, even at the speed of zero, the safety gear triggering curve 90 is offset from the safety gear traveling curve 91, which illustrates the actual braking process of the car 12 on the basis of the braking effect of the safety gear 74. The offset disposition of the two curves 90 and 91 results from the speed-independent drawing-in distance $s_{Ein}$ of the safety gear 74.

As already explained, the stopping distance $s_{FA}$, and also the safety gear triggering curve 90, are obtained from the following formula:

$$s_{FA}=v\cdot t_{reak}+s_{Ein}+v^2/2a_{FA} \quad (1)$$

where $t_{reak}$ corresponds to the system reaction time of the safety gear 74 and $a_{FA}$ denotes the braking acceleration (deceleration) of the active safety gear 74. The parameters $t_{reak}$, $s_{Ein}$ and $a_{FA}$ can be input into the determining unit 60 via the input line 61 by means of the central input and output unit 63.

Figure 3:
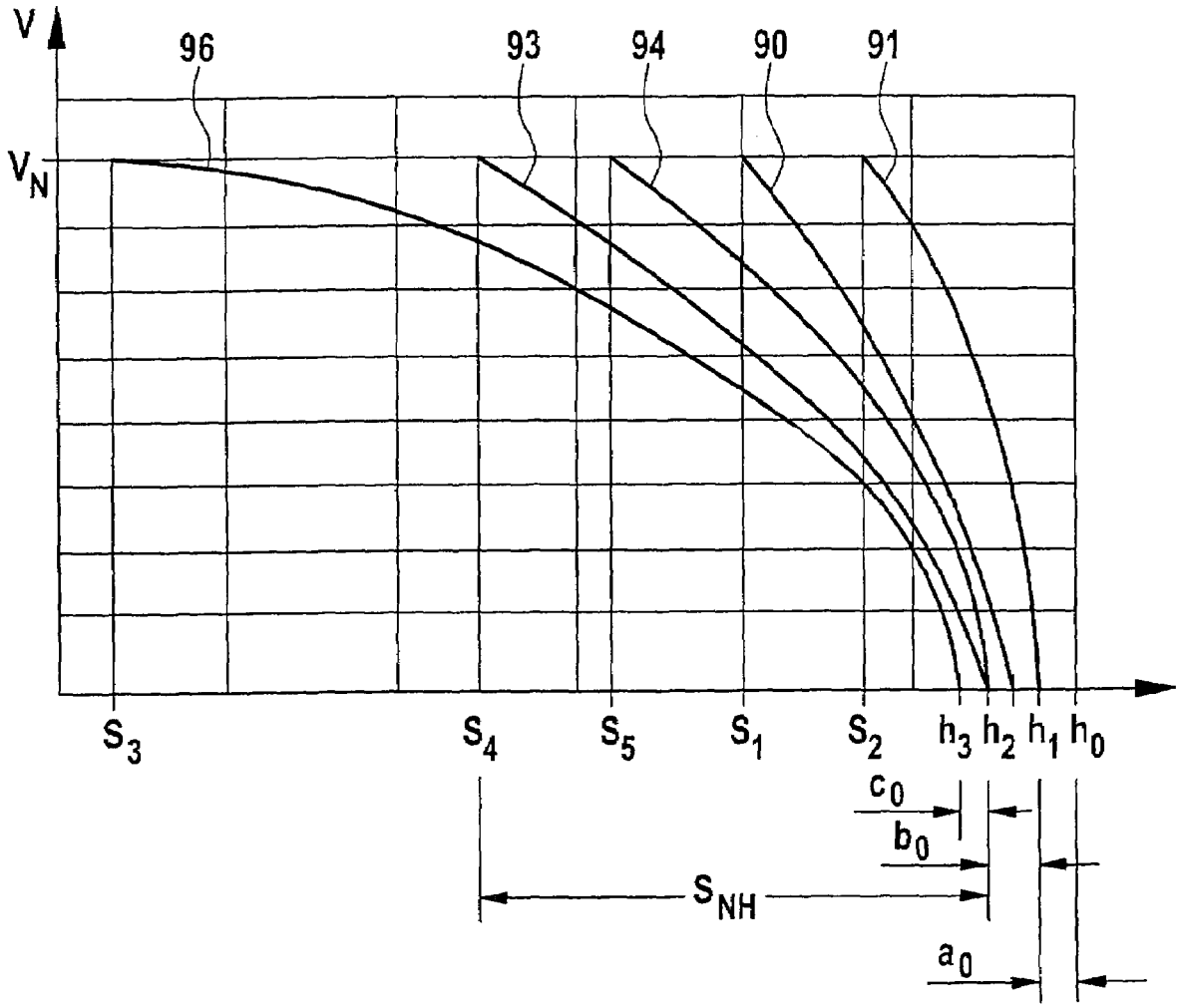
FIG. 3 shows a deceleration curve, an emergency stop triggering curve and an emergency stop traveling curve and also a safety gear triggering curve and a safety gear traveling curve of a car of the elevator installation.

The safety gears 74 and 80 represent the last safety stage allowing the cars 12, 14 to be brought to a standstill. Before the safety gears 74, 80 become active, the cars 12, 14 can be brought to a standstill by triggering an emergency stop, if the actual distance determined by the distance determining unit 55 goes below the critical distance determined by means of the determining unit 60. The critical distance can be determined in accordance with a prescribable emergency stop triggering curve 93, which is illustrated in FIG. 3 along with the emergency stop traveling curve 94 corresponding to it on the basis of the example of the upper car 12. For purposes of illustration, in FIG. 3 the safety gear triggering curve 90 and the safety gear traveling curve 91 are also shown, and additionally also the operational deceleration curve 96, which is used by the control unit 28 for braking the upper car 12 in normal operation. If the car 12 approaches an absolute stopping point $h_0$ at nominal speed $v_N$, in normal operation it is continuously braked by the control unit 28 when the location $s_3$ is reached, so that it comes to a standstill at the stopping point $h_3$. If, on account of a fault, the car 12 cannot be braked in a proper manner, it initially maintains its nominal speed $v_N$, until it meets the emergency stop triggering curve 93 at the location $s_4$. The location $s_4$ is away from a stopping point $h_2$ by the stopping distance $s_{NH}$. When the location $s_4$ is reached, an emergency stop of the car 12 is triggered by means of the emergency stop triggering device 70. When this happens, the car 12 initially maintains its nominal speed $v_N$ on account of the system reaction time $t_{reak}$, which corresponds to the time interval between the triggering of the emergency stop and the full braking effect of the brake 23 becoming active. When the brake 23 is active, the car 12 is then effectively braked in the region between the location $s_5$ and the stopping point $h_2$ in accordance with the emergency stop traveling curve 94, so that it comes to a standstill at the stopping point $h_2$.

The stopping point $h_2$ is offset from the stopping point $h_1$ by the traveling curve distance value $b_0$, which corresponds to the speed zero when the safety gear 74 is triggered. By offsetting the stopping points of the emergency stop traveling curve 94 and the safety gear traveling curve 91, it is ensured that the safety gear 74 is not triggered if an emergency stop of the car 12 is properly performed, with the movement of the car 12 following the emergency stop traveling curve 94. If, however, after triggering an emergency stop, there is a deviation of the movement of the car 12 from the emergency stop traveling curve 94 as a result of inadequate deceleration, the increased speed of the car 12 has the result that the safety gear triggering curve 90 is reached and the safety gear 74 is triggered, and the movement of the car 12 then follows the safety gear traveling curve 91, so that the car 12 comes to a standstill at the stopping point $h_1$.

The stopping distance $s_{NH}$, and with it also the emergency stop triggering curve, is obtained from the following formula:

$$s_{NH}=v\cdot t_{reak}+v^2/2a_{NH} \quad (2)$$

where $t_{reak}$ corresponds to the system reaction time of the brake and $a_{NH}$ denotes the braking acceleration (deceleration) of the active brake. These parameters can likewise be input into the determining unit 60.

As already explained, during braking in normal operation the movement of the car follows the operational deceleration curve 96, so that the car comes to a standstill at the stopping point $h_3$. This is offset from the stopping point $h_2$ by the distance $c_0$. This ensures that, given proper movement of the car 12 in accordance with the operational deceleration curve 96, an emergency stop is not triggered, since the operational deceleration curve 96 does not touch the emergency stop triggering curve 93. The safety distance $a_0$, the traveling curve distance value $b_0$ and the distance $c_0$ can likewise be input into the determining unit 60.

Figure 4:
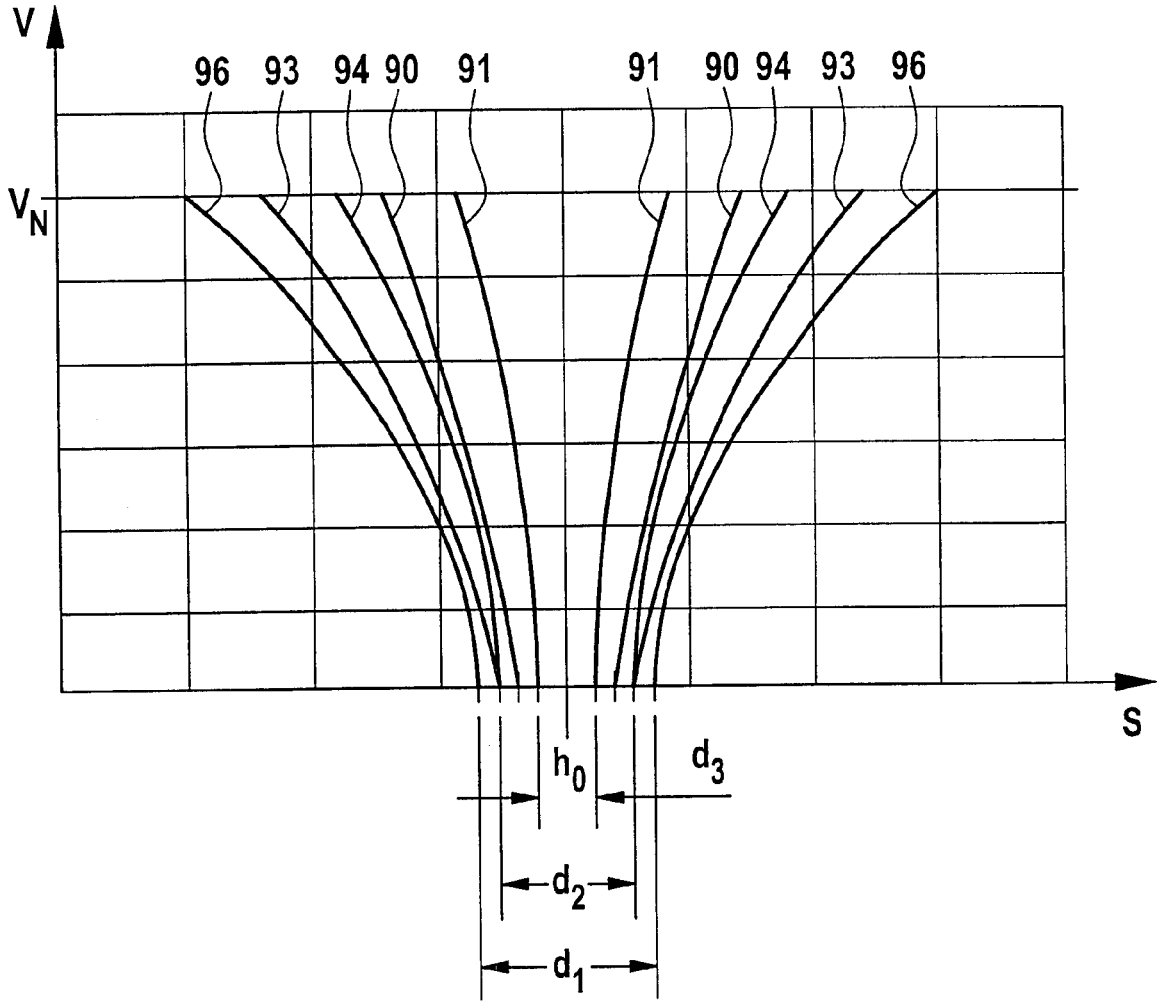
FIG. 4 shows a deceleration curve, emergency stop triggering curve and emergency stop traveling curve and also a safety gear triggering curve and safety gear traveling curve of two cars of the elevator installation approaching each other.

Represented in FIG. 4 are the movement curves of the cars 12 and 14 if they travel toward each other at nominal speed $v_N$. In normal operation, the two cars 12 and 14 are braked by the respective control unit 28 and 30 in accordance with the programmable operational deceleration curves 96, so that they come to a standstill with a minimal clear distance $d_1$ between each other. In the event of a fault, the cars 12 and 14 traveling toward each other are braked by means of the safety device 42, in that an emergency stop is respectively triggered in accordance with the emergency stop triggering curves 93, so that the cars 12 and 14 are braked according to the emergency stop traveling curves 94 and come to a standstill with the distance $d_2$ between them.

If the cars 12 and 14 traveling toward each other also cannot be properly braked by means of the emergency stop, the respective safety gear 74 or 80 is triggered by the safety device 42 in accordance with the safety gear triggering curves 90, so that the cars 12 and 14 come to a standstill with the distance $d_3$ between them after running through the safety gear traveling curves 91.

The distance $d_3$ corresponds to the accumulated safety distances $a_0$ of the two cars, the safety distance $a_0$ referring to the absolute stopping point $h_0$, which is calculated by the determining unit 60 on the basis of the speeds and traveling directions of the two cars 12, 14. The distance $d_2$ corresponds to the sum of the safety distances $a_0$ and the traveling curve distance value $b_0$ of the two cars, and the minimal clear distance $d_1$ corresponds to the sum of the distances $a_0$, $b_0$ and $c_0$ of the two cars. The minimum distance between the two cars 12, 14 is the sum of the stopping distances $s_{FA}$ of the cars 12, 14 when the safety gear 74, 80 is triggered plus the distance $d_3$ between the cars 12, 14 after they are braked. The critical distance between the two cars 12, 14 is the sum of the stopping distances $s_{NH}$ of the cars 12, 14 in the event of an emergency stop plus the distance $d_2$ between the cars 12, 14 after they are braked. The critical distance and the minimum distance are continuously calculated by the determining unit 60. If the actual distance goes below the calculated distance values, an emergency stop is triggered by the control device 42 for both cars, or the safety gears 74, 80 are triggered.

It is clear from the above that, in normal operation, the two cars 12, 14 can approach each other up to the minimal clear distance $d_1$ without an emergency stop being triggered or a safety gear being activated. The triggering of an emergency stop takes place by calculating a critical distance in accordance with a prescribable emergency stop triggering curve, and the triggering of a safety gear takes place by calculating a minimum distance in accordance with a safety gear triggering curve. In normal operation, the movement of a car follows a programmable operational deceleration curve, and it is ensured by the offset disposition of the operational deceleration curve, the emergency stop traveling curve and the safety gear traveling curve, both in relation to one another and in relation to a prescribable absolute stopping point $h_0$, that, if operation is properly conducted, neither an emergency stop nor a safety gear is triggered in spite of the cars 12, 14 coming very close together, but a car collision is reliably avoided.

The invention claimed is:

1. Elevator installation comprising at least one car, which can be made to travel in a shaft along a traveling path and has a safety gear, wherein a control unit, a drive and a brake are associated with the car and further comprising a safety device with a speed determining unit for determining the current speed of the at least one car, a distance determining unit for determining the actual distance of the at least one car from an obstacle, another car or an end of the shaft, and a determining unit for determining a critical distance and a minimum distance, which are dependent on the speed of the at least one car, it being possible by means of the safety device to trigger an emergency stop of the at least one car if the actual distance is less than the critical distance, and it being possible to trigger the safety gear of the at least one car if the actual distance is less than the minimum distance, the movement of the car when an emergency stop is properly performed following an emergency stop traveling curve, which represents the variation in speed of the car that is to be expected when the emergency stop is triggered, in dependence on the distance covered by the car, and the movement of the car when the safety gear is functioning properly following a safety gear traveling curve, which represents the variation in speed of the car that is to be expected when the safety gear is triggered, in dependence on the distance covered by the car, wherein it is possible by means of the determining unit to determine the critical distance in accordance with a prescribable emergency stop triggering curve and the minimum distance in accordance with a prescribable safety gear triggering curve, the safety gear triggering curve not touching the emergency stop traveling curve, and wherein it is possible to trigger the safety gear even before the car has reached the location with which the speed of zero is associated according to the emergency stop traveling curve.

2. Elevator installation according to claim 1, wherein the emergency stop traveling curve is offset at the speed of zero by a prescribable distance value in relation to the safety gear traveling curve.

3. Elevator installation according to claim 1, wherein, for braking in normal operation, the car can be braked by means of the control unit in accordance with a prescribable operational deceleration curve, the operational deceleration curve not touching the emergency stop triggering curve and it being possible for an emergency stop to be triggered even before the car to be braked has reached the location with which the speed of zero is associated according to the operational deceleration curve.

4. Elevator installation according to claim 3, wherein the operational deceleration curve is offset at the speed of zero by a distance value in relation to the emergency stop traveling curve.

5. Elevator installation according to claim 1, wherein the critical distance and the minimum distance can be determined independently of each other.

6. Elevator installation according to claim 1, wherein, for braking in normal operation, the at least one car can be controlled by means of the control unit in accordance with a prescribable operational deceleration curve, the operational deceleration curve, the emergency stop traveling curve and the safety gear traveling curve being offset at the speed of zero both in relation to one another and in relation to the position of an obstacle, another car or an end of the shaft.

7. Elevator installation according to claim 1, wherein the minimum distance can be determined taking into account the current speed of the car as well as the system reaction time, the drawing-in distance and the braking acceleration of the safety gear of the car.

8. Elevator installation according to claim 7, wherein the minimum distance can be determined taking into account a prescribable safety distance which the car brought to a standstill by means of the safety gear is to assume at the least from an obstacle, another car or the end of the shaft.

9. Elevator installation according to claim 8, wherein the minimum distance can be calculated by means of the determining unit, it being possible to input the safety distance and the system reaction time, the drawing-in distance and the braking acceleration of the safety gear into the determining unit.

10. Elevator installation according to claim 1, wherein the critical distance can be determined taking into account the current speed of the car and also the system reaction time and the braking acceleration of the brake associated with the at least one car and a prescribable traveling curve distance value, the traveling curve distance value corresponding to the distance of the emergency stop traveling curve from the safety gear traveling curve at the speed of zero.

11. Elevator installation according to claim 10, wherein the critical distance can be determined taking into account a prescribable safety distance which the car brought to a standstill by emergency stopping is to assume at the least from an obstacle, another car or an end of the shaft.

12. Elevator installation according to claim 10, wherein the critical distance can be calculated by means of the determining unit, it being possible to input the system reaction time and the braking acceleration of the brake associated with the at least one car into the determining unit.

13. Elevator installation according to claim 1, wherein the elevator installation comprises a shaft information system, which is coupled to the safety device.

14. Elevator installation according to claim 13, characterized in that the shaft information system (36, 38) comprises a position sensor, which transmits the position of an associated car (12, 14) to the safety device (42).

15. Elevator installation according to claim 14, wherein, in addition to the position of the associated car, the position sensor also transmits to the safety device its speed and/or its direction of movement.

16. Elevator installation according to claim 13, wherein the shaft information system has a barcode information system.

* * * * *